US006604365B2

(12) United States Patent
Sekimoto et al.

(10) Patent No.: US 6,604,365 B2
(45) Date of Patent: Aug. 12, 2003

(54) THERMAL LINK ASSEMBLY AND CRYOSTAT USING SAME

(75) Inventors: Yutaro Sekimoto, Tokyo (JP); Katsuhiro Narasaki, Ehime-ken (JP); Kazufusa Noda, Tokyo (JP)

(73) Assignees: Japan as represented by Director-General of National Astronomical Observatory, Tokyo (JP); Sumitomo Heavy Industries, Ltd., Tokyo (JP); Oshima Prototype Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/279,158

(22) Filed: Oct. 24, 2002

(65) Prior Publication Data

US 2003/0106326 A1 Jun. 12, 2003

(30) Foreign Application Priority Data

Oct. 26, 2001 (JP) ..... 2001-328966

(51) Int. Cl.[7] ..... F25B 19/00
(52) U.S. Cl. ..... 62/51.1; 62/383; 165/185
(58) Field of Search ..... 62/383, 51.1; 165/185

(56) References Cited

U.S. PATENT DOCUMENTS 5,111,665 A * 5/1992 Ackermann ..... 62/383
5,176,003 A * 1/1993 Horikawa et al. ..... 62/51.1
5,642,624 A * 7/1997 Gore ..... 62/51.1
5,682,751 A * 11/1997 Langhorn et al. ..... 165/185

OTHER PUBLICATIONS

Orlowska, A. et al. Receiver Cryogenic System, Alma Project Book, Chapter 6.
Wild, W. et al. Alma Front Ends, Alma Project Book, Chapter 5.

* cited by examiner

*Primary Examiner*—Ronald Capossela
(74) *Attorney, Agent, or Firm*—Carrier, Blackman & Associates, P.C.; Joseph P. Carrier; William D. Blackman

(57) ABSTRACT

A thermal link assembly provides thermal connection between a first thermally conductive part to which it is secured, and a second thermally conductive part which is generally disk-shaped and has a peripheral cylindrical surface. The thermal link assembly includes an annular ring made of thermally conductive material, generally in a shape of a revolution with respect to an axis, including an annular base portion to be secured to the first part and a series of contact tongues arranged along the base portion. Each contact tongue has a stem and a head. The stem has i) a longitudinal axis extending generally parallel to the axis of the annular ring, ii) a first longitudinal end connected to the base portion, and iii) a second longitudinal end connected to the head. The head has a contact surface to be in contact with the peripheral cylindrical surface of the second part. The stem is capable of twisting and bending elastic deformation with respect to the longitudinal axis, so that the contact surface of the head is capable of tilting in any direction and displacing in the radial direction of the annular ring. The thermal link assembly further includes an annular band fitted around the annular ring for exerting a force to the head of each contact tongue so as to urge the contact surface of the head against the peripheral cylindrical surface of the second part.

12 Claims, 6 Drawing Sheets

FIG. 5A
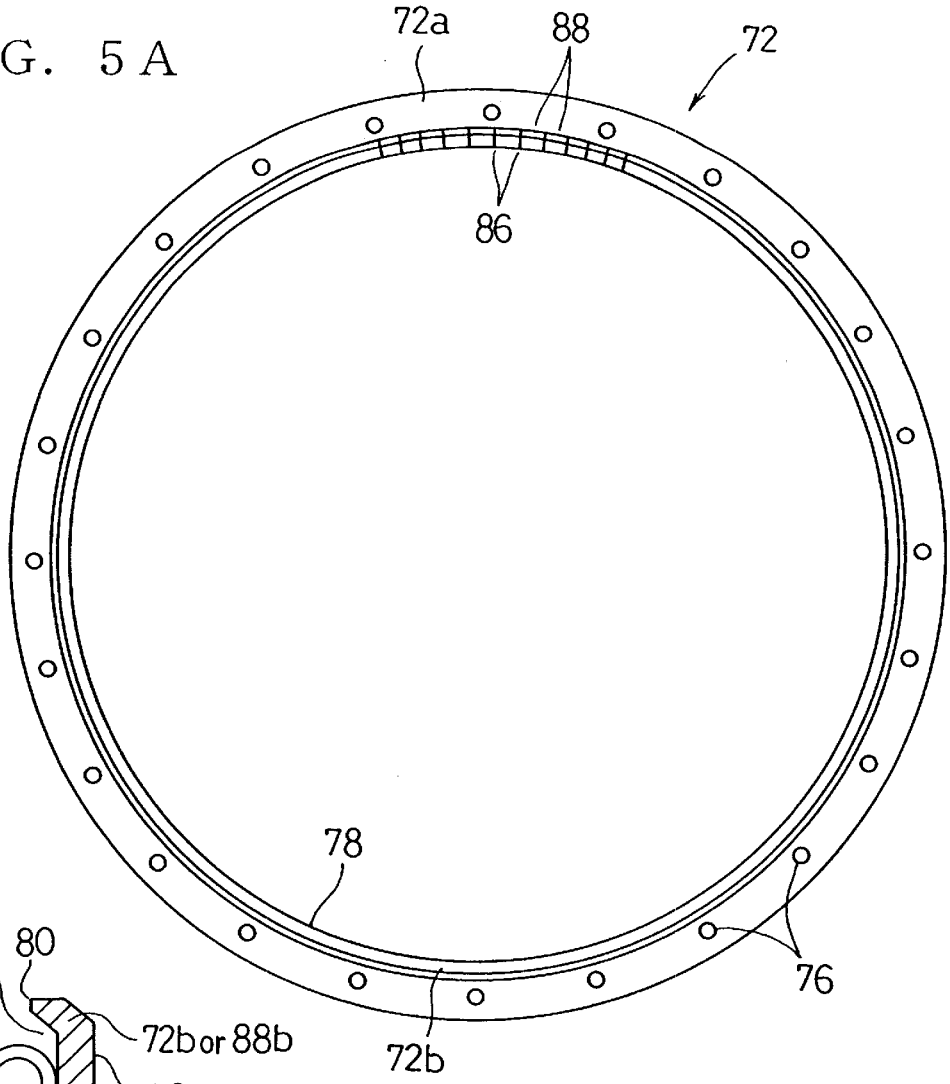
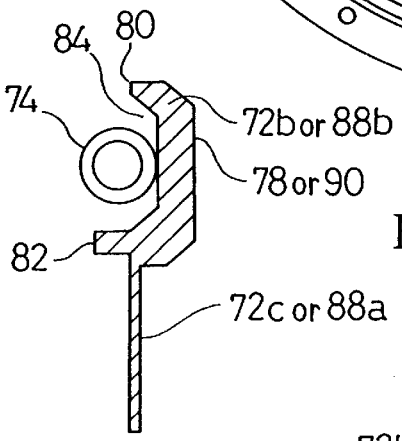
FIG. 5C
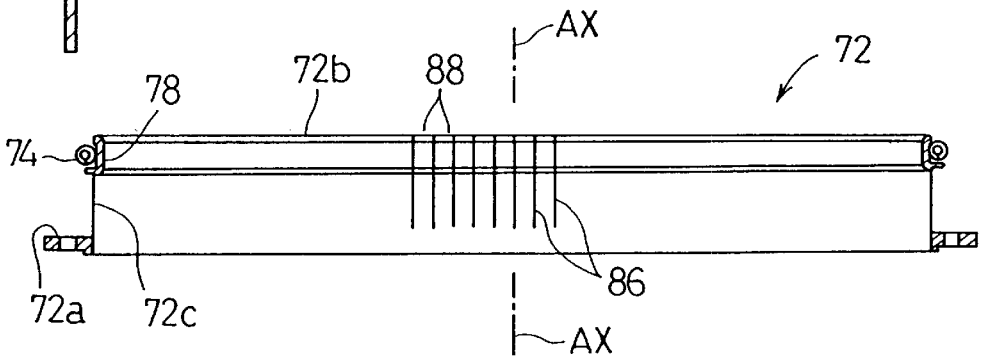
FIG. 5B

THERMAL LINK ASSEMBLY AND CRYOSTAT USING SAME

The present disclosure relates to subject matter contained in Japanese Patent Application P2001-328966 filed on Oct. 26, 2001, which is expressly incorporated herein by reference in its entirety.

BACKGROUND OF THE INVENTION

1. Field of the Invention

The present invention relates to a thermal link assembly and a cryostat using a plurality of the thermal link assemblies.

2. Description of the Related Art

There have been used radio telescopes operating in the millimeter to submillimeter wavelength range, which have a receiver system including receivers corresponding to a plurality of observational bands. In order to acquire more detailed information about a more distant target astral body, some radio telescopes are designed to include such a receiver system that uses superconducting-tunnel-junction (SIS) mixer front-ends, which advantageously provide extremely low noise operation. In order to ensure superconductivity, SIS mixer front-ends have to be housed in a cryostat for maintaining them at a cryogenic temperature, such as 4 K for example.

A cryostat for such a receiver system is described by A. Orlowska, M. Harman, and B. Ellison, "Receiver Cryogenic System," ALMA Project Book, chapter 6, Jan. 29, 2001, which is available as a pdf file at http://www.alma.nrao.edu/projectbk/construction/.

The cryostat described by Orlowska et. al. includes a vacuum container that provides thermal insulation, radiation shielding and cryogenic heat lift. Three temperature stages are constructed within the vacuum container. Each temperature stage has a metallic base plate having a good heat conductivity. The base plates of the temperature stages are arranged parallel to each other in a stacked fashion and are cooled by a cryogenic cooler having three cold stages.

In the cryostat of Orlowska et. al., the radio frequency and other electronic components that form an individual receiver corresponding to a specific observational band are integrated into an autonomous support structure called a "cartridge," which is adapted for insertion into and removal from the vacuum container through an insertion hole formed in the bottom end plate of the container. The base plates of the temperature stages have holes for receiving the cartridges. Each cartridge has three disk-shaped metallic "cold plates" arranged in a stacked fashion. On the top cold plate of a cartridge, various electronic components are mounted. Further, the three cold plates of a cartridge form part of the corresponding three temperature stages, so that the three cold plates have to be thermally connected with the corresponding base plates. This is achieved through thermal link assemblies. The thermal link assembly is a ring-shaped assembly having an inner cylindrical surface to be in contact with the peripheral cylindrical surface of the disk-shaped cold plate. The thermal link assembly is attached to one base plate and receives one cold plate, so as to provide thermal connection between them.

The thermal link assembly described by Orlowska et. al., however, suffers from several drawbacks including providing only insufficient thermal conduction properties, being relatively heavy in weight and relatively massive in size and requiring relatively high manufacturing costs.

SUMMARY OF THE INVENTION

In view of the foregoing, it is an object of the present invention to provide a thermal link assembly which may provide good thermal conduction properties, may be relatively light in weight and relatively compact in size, as well as may be manufactured at relatively low costs.

It is another object of the present invention to provide a cryostat using such thermal link assemblies.

In accordance with the present invention, there is provided a thermal link assembly for providing thermal connection between first and second thermally conductive parts. The thermal link assembly is adapted to be secured to the first part. The second part is generally disk-shaped and has a peripheral cylindrical surface. The thermal link assembly comprises an annular ring made of thermally conductive material. The annular ring is generally in a shape of a revolution with respect to an axis. The annular ring includes an annular base portion to be secured to the first part and a series of contact tongues arranged along the base portion. Each contact tongue has a stem and a head. The stem has i) a longitudinal axis extending generally parallel to the axis of the annular ring, ii) a first longitudinal end connected to the base portion, and iii) a second longitudinal end connected to the head. The head has a contact surface which contacts the peripheral cylindrical surface of the second part. The stem is capable of twisting and bending elastic deformation with respect to the longitudinal axis, so that the contact surface of the head is capable of tilting in any direction and displacing in the radial direction of the annular ring. Finally, the thermal link assembly further comprises an annular band fitted around the annular ring for exerting a force to the head of each contact tongue so as to urge the contact surface of the head against the peripheral cylindrical surface of the second part.

The annular ring may further include i) an annular proximal portion defining an inner cylindrical surface and ii) a thin-wall cylindrical intermediate portion connecting the base portion and the proximal portion. In such case, the annular ring may have a plurality of axial slits formed at fixed circumferential intervals. Each axial slit extends from adjacent the base portion, across the thin-wall cylindrical intermediate portion and throughout the annular proximal portion, so that i) a region of the thin-wall intermediate portion between adjacent two of the axial slits defines the stem of each contact tongue, ii) a region of the annular proximal portion between adjacent two of the axial slits defines the head of each contact tongue, and iii) a region of the inner cylindrical surface between adjacent two of the axial slits defines the contact surface of the head of each contact tongue.

The annular ring may be made of metallic material. The inner cylindrical surface of the annular ring may have a diameter in a range 100 to 300 mm. The stem of each contact tongue may have a constant thickness as measured in the radial direction of the annular ring and a constant width as measured in the circumferential direction of the annular ring. In such case, the stem of each contact tongue may have a thickness in a range 0.2 to 0.8 mm, a width in a range 2.5 to 15 mm and a length in a range 5 to 50 mm.

In case where the inner cylindrical surface of the annular ring has a diameter in a range 100 to 200 mm, the stem of each contact tongue may have a thickness in a range 0.2 to 0.5 mm, a width in a range 2.5 to 8 mm and a length in a range 5 to 30 mm.

In accordance with the present invention, there is also provided a cryostat for a receiver system used in a radio telescope. The cryostat comprises: a vacuum container; a plurality of cartridges capable of insertion into and removal from the vacuum container, each cartridge having i) at least one thermally conductive cold plate which is generally disk-shaped and has a peripheral cylindrical surface and ii) a receiver mounted on the cold plate; at least one temperature stage constructed in the vacuum container, the temperature stage having a thermally conductive base plate; a cryogenic cooler for heat lift of the temperature stage; and a plurality of thermal link assemblies, each secured to one of the base plates and providing thermal connection between the base plate and one of the cold plates. Each thermal link assembly comprises an annular ring made of thermally conductive material. The annular ring is generally in a shape of a revolution with respect to an axis. The annular ring includes an annular base portion to be secured to the base plate and a series of contact tongues arranged along the base portion. Each contact tongue has a stem and a head. The stem has i) a longitudinal axis extending generally parallel to the axis of the annular ring, ii) a first longitudinal end connected to the base portion, and iii) a second longitudinal end connected to the head. The head has a contact surface adapted to be in contact with the peripheral cylindrical surface of the cold plate. The stem is capable of twisting and bending elastic deformation with respect to the longitudinal axis, so that the contact surface of the head is capable of tilting in any direction and displacing in the radial direction of the annular ring. Finally, the thermal link assembly further comprises an annular band fitted around the annular ring for exerting a force to the head of each contact tongue so as to urge the contact surface of the head against the peripheral cylindrical surface of the cold plate.

For the above cryostat, the annular ring may further include i) an annular proximal portion defining an inner cylindrical surface and ii) a thin-wall cylindrical intermediate portion connecting the base portion and the proximal portion. In such case, the annular ring may have a plurality of axial slits formed at fixed circumferential intervals. Each axial slit extends from adjacent the base portion, across the thin-wall cylindrical intermediate portion and throughout the annular proximal portion, so that i) a region of the thin-wall intermediate portion between adjacent two of the axial slits defines the stem of each contact tongue, ii) a region of the annular proximal portion between adjacent two of the axial slits defines the head of each contact tongue, and iii) a region of the inner cylindrical surface between adjacent two of the axial slits defines the contact surface of the head of each contact tongue.

BRIEF DESCRIPTION OF THE DRAWINGS

The above and other objects, features and advantages of the present invention will be apparent from the following detailed description of a preferred embodiment thereof, reference being made to the accompanying drawings, in which:

FIGS. 5A to 5D shows a thermal link assembly constructed and arranged in accordance with a preferred embodiment of the present invention.

DETAILED DESCRIPTION OF A PREFERRED EMBODIMENT

Referring now to the accompanying drawings, a cryostat in accordance with a preferred embodiment of the present invention will be described in detail.

Figure 1:
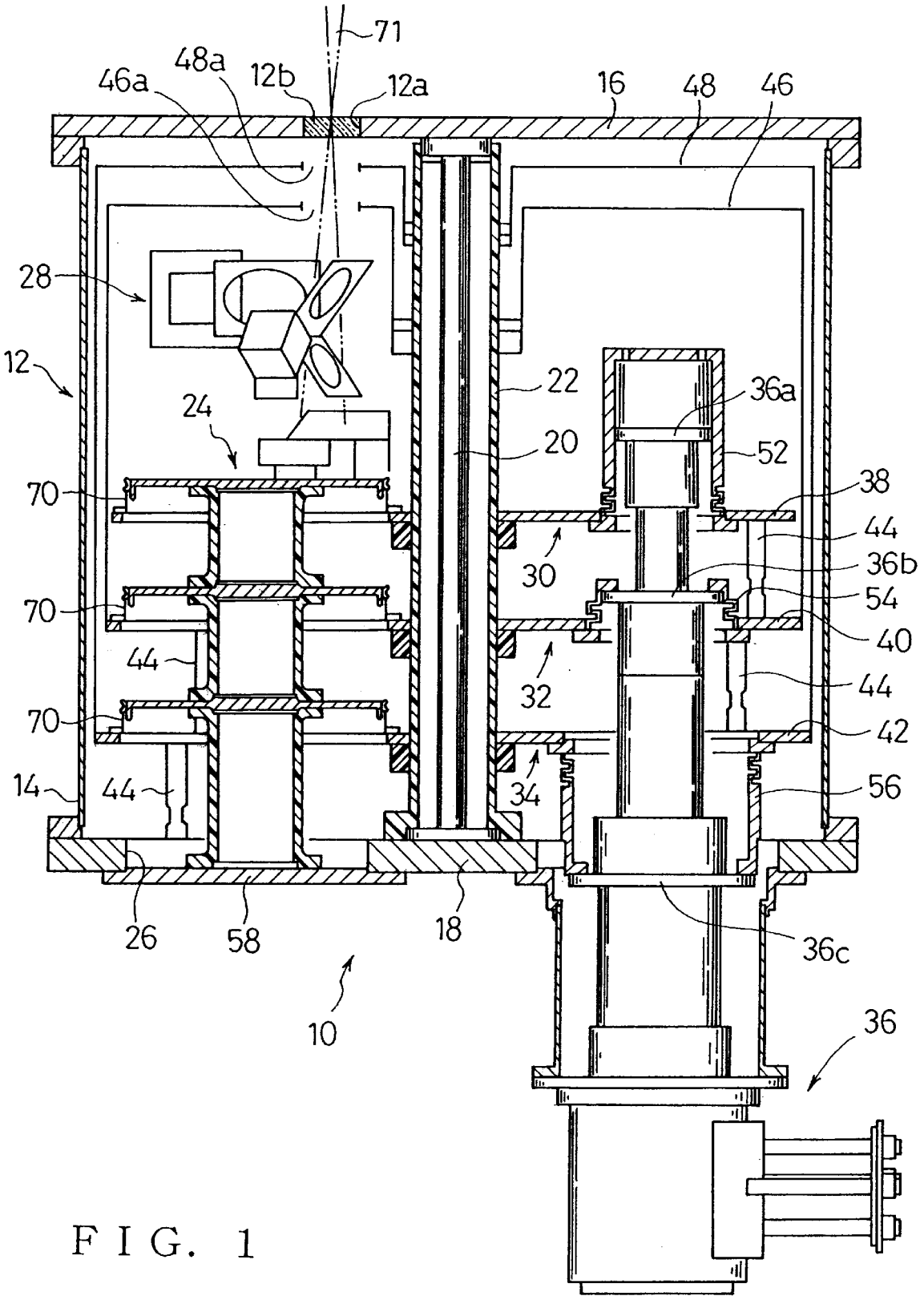
FIG. 1 is a longitudinal cross-sectional view of a cryostat constructed and arranged in accordance with a preferred embodiment of the present invention.

FIG. 1 shows a cryostat 10 constructed and arranged in accordance with a preferred embodiment of the present invention. The cryostat 10 serves to house a receiver system, which is used in a radio telescope operating in the millimeter/submillimeter range. The receiver system has three observational bands defined in that wavelength range and includes three receivers corresponding to the bands. Each receiver includes a superconducting-tunnel-junction (SIS) mixer front-end, which advantageously provides extremely low noise operation. During operation of the radio telescope, the cryostat 10 maintains the SIS mixer front-ends at a very low temperature of about 4 K in order to ensure superconductivity of the SIS mixer front-ends.

The cryostat 10 includes a vacuum container 12 that provides thermal insulation, radiation shielding and cryogenic heat lift. The vacuum container 12 includes a cylinder 14 capped at both ends with end plates 16 and 18, which may be also referred to as "the top end plate (16)" and "the bottom end plate (18)" hereinafter. The cryostat 10 has ports for vacuum pump (not shown) and vacuum gauge attachment (not shown). The vacuum container 12 further includes a central support post 20 introduced between the end plates 16 and 18 for reducing deflection of the end plates 16 and 18 when the vacuum container 12 is evacuated. The cylinder 14, the end plates 16 and 18, and the support post 20 are made of high-rigidity material, such as stainless steel or aluminum. The central support post 20 is covered by a sheath 22 made of thermally insulative material, such as glass fiber reinforced plastic. The vacuum container 12 may be formed to have an appropriate volume to house the receiver system. For example, the vacuum container 12 may have a diameter of about 1.0 m and a height of about 0.7 m.

Figure 2:
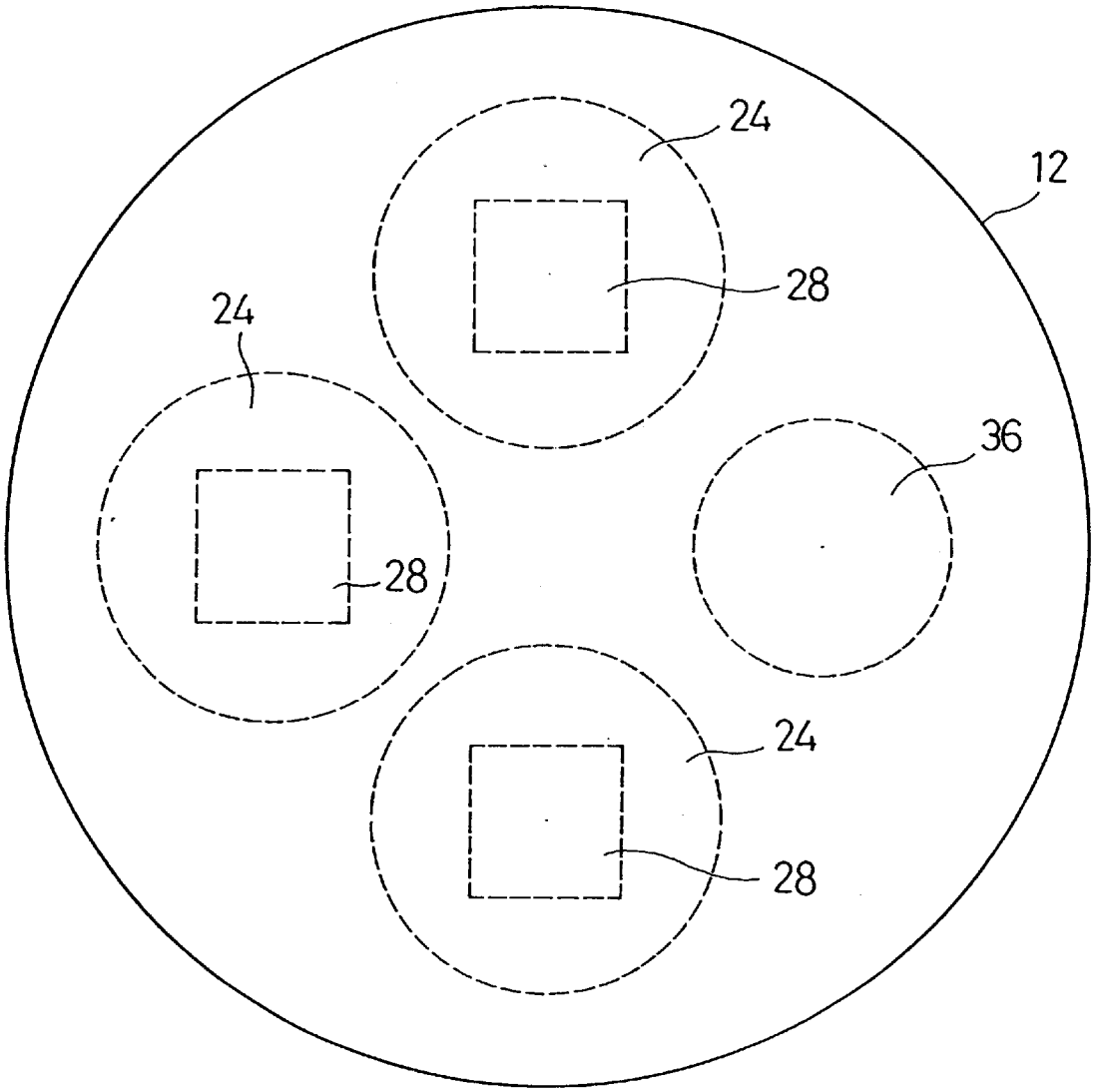
FIG. 2 is a schematic plan view of the cryostat of FIG. 1.

The cryostat 10 further includes three "cartridges" 24 corresponding to the three observational bands, respectively. The cartridges 24 are arranged in the vacuum container 12 at angular intervals of about 90 degrees, as shown in FIG. 2. Of course, the cryostat 10 may be formed to house more or less cartridges. Each cartridge 24 is an autonomous support structure adapted for insertion into and removal from the vacuum container 12 through a corresponding insertion hole 26 formed in the bottom end plate 18 of the vacuum container 12. Each cartridge 24 contains all the necessary components (including internal optics and an SIS mixer front-end), ancillary electronics and cabling associated with an individual receiver 28 (indicated schematically by a box 28 in FIG. 2) of a specific front-end band.

The cryostat 10 includes three temperature stages 30, 32 and 34 constructed within the vacuum container 12. The cryostat 10 further includes a cryogenic cooler 36 provided in the vacuum container 12 for heat lift of the temperature stages 30, 32 and 34. The cryogenic cooler 36 and the temperature stages 30, 32 and 34 cooperate to provide a cryogenic temperature of about 4 K suitable for operation of the SIS mixers.

In terms of functionality, the stage 34 should be referred to as "the first" temperature stage, the stage 32 as "the second" temperature stage and the stage 30 as "the third" temperature stage. For clarity of explanation, however, the third temperature stage 30 is described first and the first temperature stage 34 last.

The third temperature stages is a heat sink stage 30, on which the SIS mixer front-ends of the receiver system are mounted. That is, the heat sink stage 30 provides a cryogenic temperature of about 4 K for the SIS mixer front-ends. The second temperature stage is an internal radiation shield stage 32, which is maintained at a cryogenic temperature of about 12 K and encloses the heat sink stage 30. The first temperature stage is another internal radiation shield stage 34, which is maintained at a cryogenic temperature in a range 70 to 80 K and encloses the above mentioned internal radiation shield stage 32. Thus, the heat sink stage 30 is enclosed double by the two internal radiation shield stages 32 and 34 in order to reduce the radiative thermal load posed on the heat sink stage 30 maintained at a temperature of about 4 K. Hereinafter, the "outside" internal radiation shield stage 34 may be referred to as "the first" internal shield stage and the "inside" internal radiation shield stage 32 as "the second" internal shield stage.

More specifically, each of the temperature stages 30, 32 and 34 includes a base plate made of thermally conductive material, such as copper or aluminum. The base plates 38, 40 and 42 are arranged in a stacked fashion and extend in parallel to the end plates 16 and 18 of the vacuum container 12. The base plates 38, 40 and 42 are supported by the central, thermally insulative sheath 22 and auxiliary support posts 44, which are made of thermally insulative material as well. In this arrangement, the base plates 38, 40 and 42 are thermally isolated from each other as well as from the vacuum container 12.

The second internal radiation shield stage 32 also includes a shroud 46, which is made of thermally conductive material, such as copper or aluminum, and attached to the base plate 40. The base plate 40 and the shroud 46 together define a substantially closed space for enclosing the heat sink stage 30.

Similarly, the first internal radiation shield stage 34 also includes a shroud 48, which is made of thermally conductive material, such as copper or aluminum, and attached to the base plate 42. The base plate 42 and the shroud 48 together define a substantially closed space for enclosing the second internal radiation shield stage 32.

The base plates 38, 40 and 42, which have good thermal conduction properties because of their material, are cooled by the cryogenic cooler 36. The cryogenic cooler 36 is a three-stage cooler having three cold stages 36*a*, 36*b* and 36*c*, which provide cryogenic temperatures of about 4 K, 12 K and 80 K, respectively. The cold stages 36*a*, 36*b* and 36*c* of the cryogenic cooler 36 are thermally connected with the base plates 38, 40 and 42 by means of thermal connecters 52, 54 and 56, respectively, as shown in FIG. 1. The thermal connecters 52, 54 and 56 are made of thermally conductive material, such as copper or aluminum, so that they provide good thermal conduction between the base plates 38, 40 and 42 and the corresponding cold stages 36*a*, 36*b* and 36*c*. As shown, the thermal connecters 52, 54 and 56 have a serpentine structure, which effectively provides isolation of the cold stages 36*a*, 36*b* and 36*c* from the base plates 38, 40 and 42 in terms of vibration, so as to prevent any harmful vibration of the cold stages 36*a*, 36*b* and 36*c* from transmitting to the base plates 38, 40 and 42.

Figure 3:
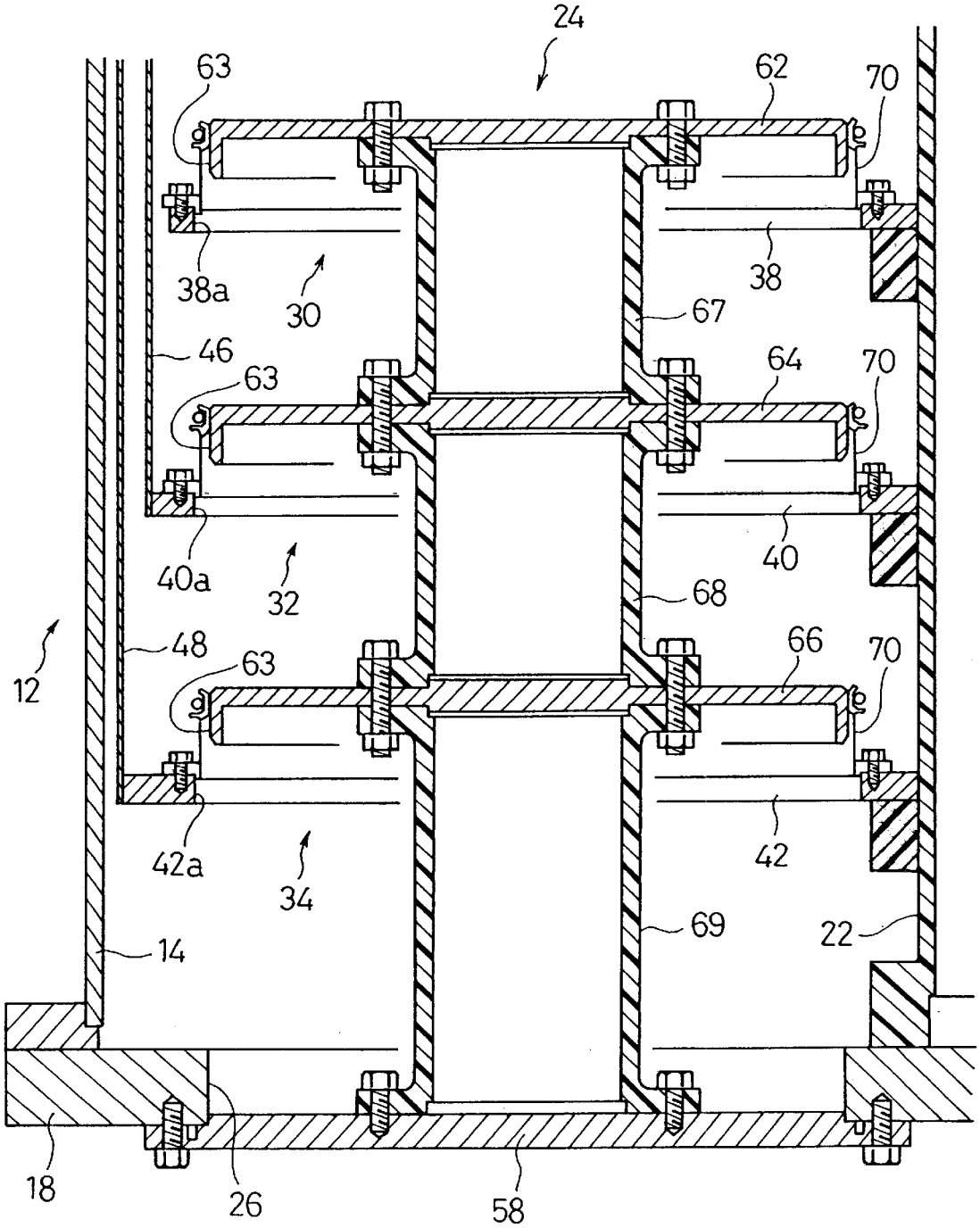
FIG. 3 is an enlarged partial view from FIG. 1 showing a cartridge of the cryostat in detail.

As best shown in FIG. 3, each cartridge 24 includes a disk-shaped bottom plate 58, which mates with the corresponding one of the insertion holes 26 formed in the bottom end plate 18 of the vacuum container 12 and is secured to the bottom end plate 18 by screws. A suitable vacuum interface, such as an O-ring, is provided between the bottom plate 58 of the cartridge 24 and the bottom end plate 18 of the vacuum container 12.

Figure 4A:
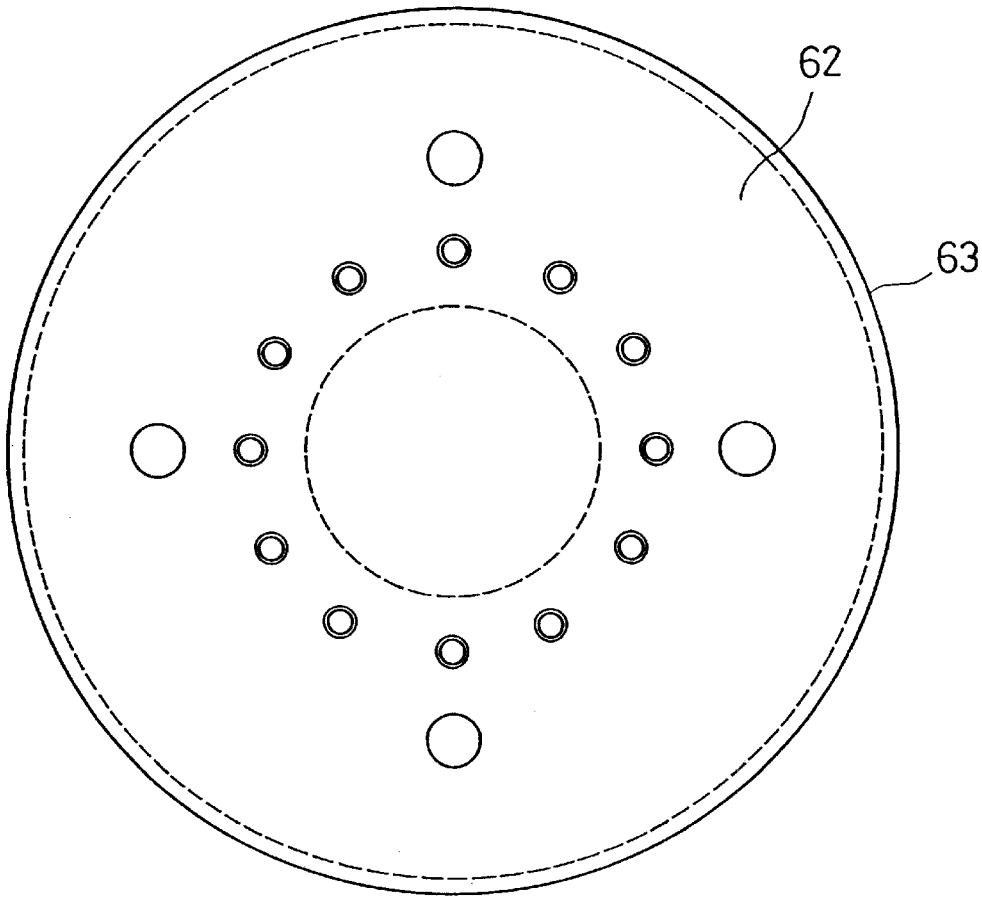
FIGS. 4A and 4B shows a cold plate of the cartridge in a plan view and a cross-sectional view, respectively.
Figure 4B:
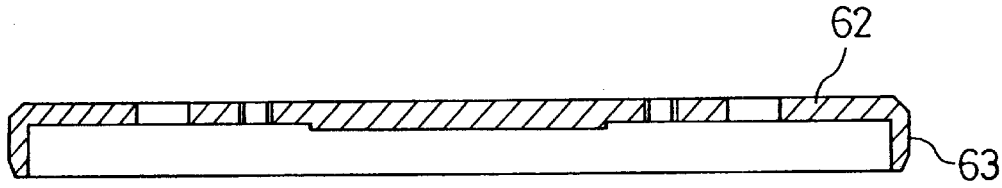

Each cartridge 24 further includes three "cold plates" 62, 64 and 66 and three thermally insulative supports 67, 68 and 69. The cold plates 62, 64 and 66 are generally disc-shaped parts made of thermally conductive material, such as copper or aluminum, and have peripheral cylindrical surfaces 63. Specifically, as shown in FIGS. 4A and 4B, the top cold plate 62 is generally disk-shaped and has a peripheral cylindrical surface 63. The middle and the lowest cold plates 64 and 66 have the same configuration, which is similar to that of the top cold plate 62 with only minor differences. The diameter of the peripheral cylindrical surface 63 of the top plate 62 is nearly equal to and slightly smaller than that of the middle cold plate 64. The difference in diameter between them may be 0.5 mm, for example. Similarly, the diameter of the peripheral cylindrical surface of the middle cold plate 64 is slightly smaller than that of the lowest cold plate.

As shown in FIG. 3, in each cartridge 24, the bottom plate 58 and the three cold plates 62, 64 and 66 are connected through the thermally insulative supports 67, 68 and 69 into a single structural unit, such that the bottom plate 58 and the three cold plates 62, 64 and 66 are i) arranged in a stacked fashion, ii) aligned to have a common axis, and iii) thermally isolated from each other by virtue of the thermally insulative properties of the supports 67, 68 and 69.

The base plates 38, 40 and temperature stages 30, 32 and 34 have cartridge-receiving holes 38*a*, 40*a* and 42*a* formed therein, through which the cartridges 24 extend when inserted into the vacuum container 12. Further, when a cartridge 24 has been inserted into the vacuum container 12, the cold plates 62, 64 and 66 of the cartridge 24 are slightly above the corresponding base plates 38, 40 and 42 and almost close the corresponding cartridge-receiving holes 38*a*, 40*a* and 42*a* formed in the base plates, respectively. In addition, the cold plates 62, 64 and 66 of the cartridge 24 are thermally connected with the base plates 38, 40 and 42, respectively, through thermal link assemblies 70.

In this arrangement, the cold plates 62, 64 and 66 form part of the corresponding temperature stages 30, 32 and 34. When the base plates 38, 40 and 42 are cooled by the cryogenic cooler 36 to cryogenic temperatures of about 4 K, 12 K and 80 K, the cold plates 62, 64 and 66 are also cooled to these temperatures by virtue of thermal connection between them; this is why they are called "the cold plates." The thermal link assemblies 70, which provide thermal connection between each of the thermally-conductive cold plates and the corresponding one of the thermally-conductive base plates 38, 40 and 42, is described later in great detail with reference to FIGS. 5A to 5D.

The internal optics and the electronic components including the SIS mixer front-end that form a receiver of a specific observational band are mounted on the top cold plate 62 of the cartridge 24 for that receiver. Thus, a radio frequency radiation beam 71 generated by the external optics (not shown) has to be guided into the receiver mounted on the top cold plate 62 housed within the vacuum container 12. For this purpose, the vacuum container 12 has vacuum windows 12*a* formed in the top end plate 16. FIG. 1 shows only one of the vacuum windows 12*a*. Each vacuum window 12*a* is aligned to the position of the inner optics of the corresponding receiver 28. In each vacuum window 12*a*, a lens 12*b* which is transparent to the incoming radiation beam 71 is fitted.

In addition, the shroud 48 of the second internal radiation shield stage 34 has input windows 48*a*, which are aligned to the positions of the vacuum windows 12*a* and thus of the internal optics of the receivers 28 mounted on the cartridges 24. Similarly, the shroud 46 of the first internal radiation shield stage 32 has input windows 46*a*, which are aligned to the positions of the vacuum windows 12*a*. The external optics associated with an antenna (not shown) generates a radio frequency radiation beam 71 in the millimeter/submillimeter range and directs the beam to the vacuum window 12*a* just above the receiver 28 that is suitable for the frequency of the radiation beam 71. The radiation beam 71 passes through that vacuum window 12*a*, and then through the corresponding input windows 48*a* and 46*a* of the shrouds 48 and 46, to reach the inner optics of the desired receiver 28. The radiation beam 71 is processed in the receiver 28 to yield necessary signals for millimeter/submillimeter range observation of a target astral body.

The thermal link assembly 70 shown in FIG. 3 is designed not only to provide good thermal connection between a cartridge and a base plate of a temperature stage, but also to permit quick insertion and removal of a cartridge into and from the vacuum container 12. This provides an advantage in that withdrawal and installation of a cartridge, and hence a complete receiver for a particular observational band, from and into the vacuum container 12 can be quickly performed with ease, without disturbing the rest of the cryostat 10. Further, this advantageously minimizes risk of damage to the remaining receivers, reduces maintenance time and avoids a potentially lengthy and difficult readjustment of the external optical components since they need not be separated from the outer vacuum container.

Specifically, as shown in FIGS. 5A to 5D, the thermal link assembly 70 comprises an annular metallic ring 72 and a coil spring band 74 fitted around the annular metallic ring 72. The metallic ring 72 is made of a metallic material having a good thermal conductivity, such as copper or aluminum. The metallic ring 72 is generally in a shape of revolution with respect to an axis AX. The metallic ring 72 has an annular base portion 72*a* to be secured to the corresponding base plate by means of screws (not shown) to be received in through holes 76. The metallic ring 72 further includes i) an annular proximal portion 72*b* defining an inner cylindrical surface 78 and ii) a thin-wall cylindrical intermediate portion 72*c* connecting the base portion 72*a* and the proximal portion 72*b*.

As shown in FIG. 5C, the annular proximal portion 72*b* has a generally C-shaped cross section, as sectioned along a plane on which the axis AX lies. The proximal portion 72*b* further has a pair of annular radial flanges 80 and 82 extending outwardly. A groove 84 is defined on the radially outer surface of the proximal portion 72*b* between the flanges 80 and 82 and receives the coil spring band 74.

The inner cylindrical surface 78 of the annular proximal portion 72*b* has a diameter corresponding to that of the peripheral cylindrical surface 63 of the corresponding cold plate. The diameter of a cold plate, and thus of a cartridge, may vary, and be typically in a range 100 to 300 mm. The annular base portion 72*a* and the cylindrical intermediate portion 72*c* have a common inner diameter, which is greater than that of the inner cylindrical surface 78 of the proximal portion 72*b*.

The metallic ring 72 has a plurality of axial slits 86 formed at fixed circumferential intervals. The width of the axial slits 86 is very small, and may be about 0.2 mm for example. Although the axial slits 86 are distributed along the metallic ring 72 completely around its circumference, FIGS. 5A and 5B show only some of them for simplicity. As shown in FIG. 5B, each axial slit 86 extends from adjacent the base portion 72*a*, across the thin-wall cylindrical intermediate portion 72*c* and throughout the proximal portion 72*b*.

Figure 5D:
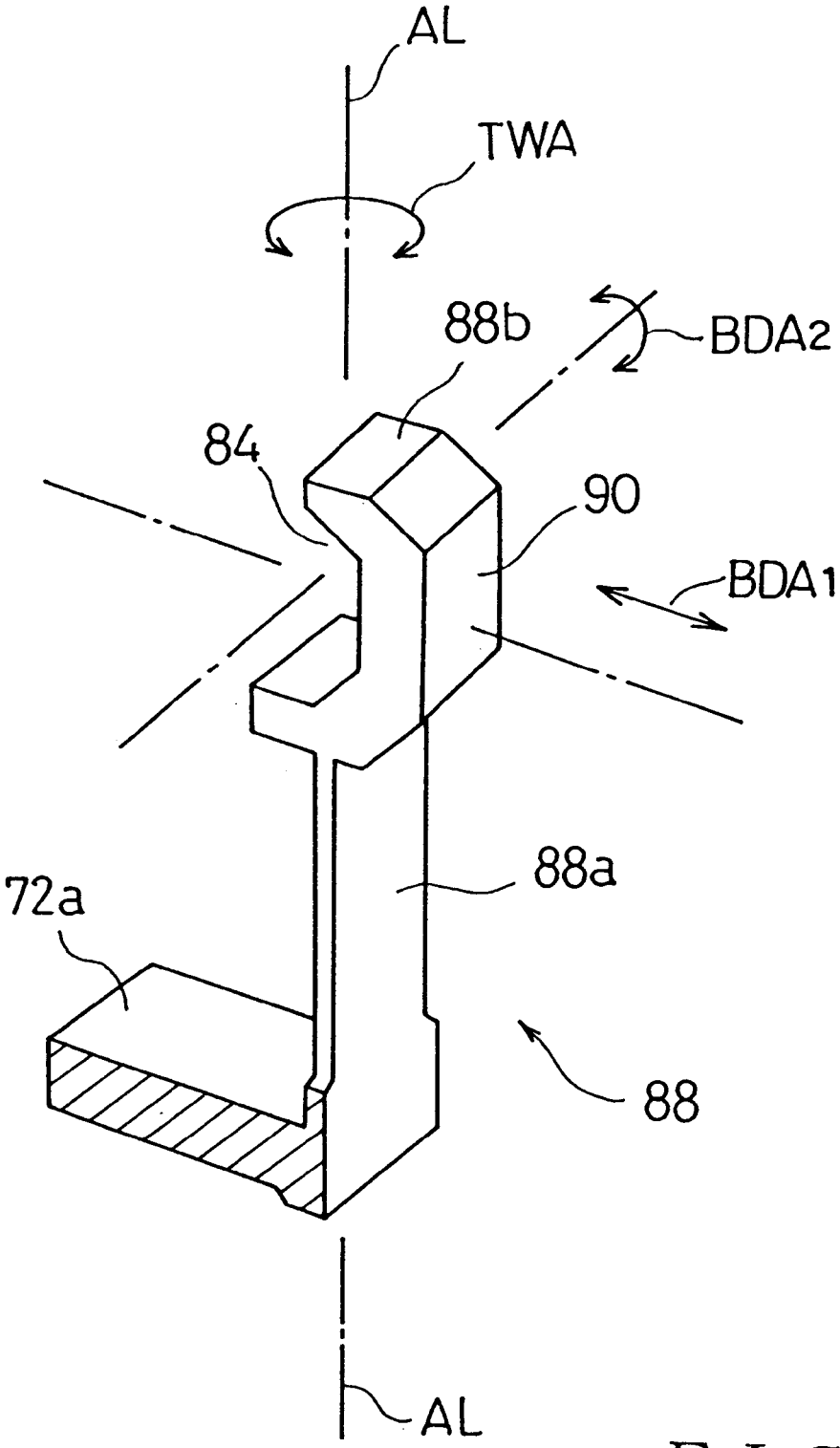

By virtue of provision of the axial slits 86, a series of contact tongues 88 are formed around the metallic ring 72. The contact tongues 88 are arranged along the annular base portion 72*a*, as shown in FIGS. 5A and 5B. FIG. 5D shows a single contact tongue 88 in detail. As seen, each contact tongue 88 has a reed-like stem 88*a* and a generally C-shaped head 88*b*. The stem 88*a* has i) a longitudinal axis AL extending generally parallel to the axis AX (shown in FIG. 5B) of the metallic ring 72, ii) a first longitudinal end connected to the base portion 72*a* of the metallic ring 72, and iii) a second longitudinal end connected to the head 88*b*. The head 88*b* has a contact surface 90 to be in contact with the peripheral cylindrical surface 63 of a cold plate.

Specifically, a region of the thin-wall cylindrical intermediate portion 72*c* between adjacent two axial slits 86 defines the stem 88*a* of each contact tongue 88. A region of the annular proximal portion 72*b* between adjacent two slits 86 defines the head 88*b* of each contact tongue 88. Further, a region of the inner cylindrical surface 78 of the proximal portion 72*b* between adjacent two axial slits 86 defines the contact surface 90 of the head 88*b* of each contact head 88.

As apparent from FIGS. 5A to 5D, the stem 88*a* has a constant thickness as measured in the radial direction of the metallic ring 72 and a constant width as measured in the circumferential direction of the metallic ring 72. The thickness, the width, as well as the length of the stem 88*a* is automatically determined by i) the dimensions of the thin-wall cylindrical intermediate portion 72*c* and ii) the interval of the axial slits 86. That is, the thickness of the stem 88*a* will be equal to the wall thickness of the intermediate portion 72*c*; the width of the stem 88*b* will be equal to the interval of the axial slits 86; and the length of the stem will be nearly equal to the width (or axial length) of the intermediate portion 72*c*.

The dimensions of the stem 88*a* are important because the elastic deformability of the stem 88*a* greatly depends on them. Specifically, the stem 88*a* should be dimensioned such that it is capable of twisting and bending elastic deformation with respect to the longitudinal axis AL, so that the contact surface 90 of the head 88*b* is capable of tilting in any direction (as shown by the arrows TWA and BDA2 in FIG. 5D) and displacing in the radial direction of the metallic ring 72 (as shown by the arrow BDA1 in FIG. 5D). In FIG. 5D, The arrow TWA indicates the twisting elastic deformation of the stem 88*a*, while the arrows BDA1 and BDA2 both indicate the bending elastic deformation of the stem 88*a*.

The coil spring band 74 is elongated and subject to a certain tension when fitted around the metallic ring 72 and received in the groove 84. The coil spring band 74 thereby exerts a force to the head 88*b* of each contact tongue 88 so as to urge the contact surface 90 of the head 88*b* against the peripheral cylindrical surface 63 of the corresponding cold plate. The contact surface 90 of the head 88*b* and the peripheral cylindrical surface 63 of the corresponding cold plate are the interfaces for the thermal connection, through which heat flows. Thus, these surfaces are finished smooth enough to ensure intimate contact with each other, in order to achieve good thermal conductivity.

With whatever precision the cryostat 10 is constructed and assembled, there has to be an inevitable error in alignment between a thermal link assembly secured on a base plate and a mating cold plate of a cartridge installed in the cryostat 10. By using the thermal link assemblies 70 described above, however, any such misalignment can be automatically and effectively compensated. Specifically, by virtue of the twisting and bending elastic deformability of the stem 88*a* of the contact tongue 88, the force applied by the coil spring band 74 to the head 88*b* of the contact tongue 88 will produce necessary tilt and/or displacement of the contact surface 90 of the head 88*b*, so that an intimate contact between the contact surface 90 of the head 88*b* of the contact tongue 88 and the peripheral cylindrical surface 63 of the mating cold plate may be ensured despite any such misalignment.

Further, the displacement capability of the contact surface 90 of the head 88*b* in the radial direction of the metallic ring 72, as provided by the bending deformability of the stem 88*a*, also serves to compensate any differences in shrinkage between the metallic ring 72 and the mating cold plate, which may possibly occur during cooling down of the cryostat 10.

The coil spring band 74 may be replaced by any suitable annular band which can provide similar functions. For example, a plastic band, such as a nylon band, may be used. Generally, any plastic material has a thermal expansion ratio greater than that of a metallic material, so that a shrinkage of a plastic band occurring during cooling down of the cryostat 10 can generate an increased tension of the band, which clamps the head 88*b* of each contact tongue 88 against the mating cold plate, so as to urge the contact surface 90 of the head 88*b* against the peripheral cylindrical surface 63 of the cold plate.

As described above, the dimensions of the stem 88*a* are important because the elastic deformability of the stem 88*a* greatly depends on them. If the inner cylindrical surface 78 or 90 of the metallic ring 72 has a diameter in a range 100 to 300 mm, then it may be preferable that the stem 88*a* of each contact tongue 88 has a thickness in a range 0.2 to 0.8 mm, a width in a range 2.5 to 15 mm and a length in a range 5 to 50 mm.

Further, if the inner cylindrical surface 90 of the metallic ring 72 has a diameter in a range 100 to 200 mm, then it may be preferable that the stem 88*a* of each contact tongue 88 has a thickness in a range 0.2 to 0.5 mm, a width in a range 2.5 to 8 mm and a length in a range 5 to 30 mm.

As understood from the above, the thermal link assembly 70 described above is highly simple in structure and has a low profile. Therefore, it may provide good thermal conduction properties, may be relatively light in weight and relatively compact in size, as well as may be manufactured at relatively low costs.

Having described the present invention with reference to a preferred embodiment thereof, it is to be understood that the present invention is not limited to the disclosed embodiment, but may be embodied in various other forms without departing from the spirit and the scope of the present invention as defined by the appended claims.

What is claimed is:

1. A thermal link assembly for providing thermal connection between first and second thermally conductive parts, wherein said thermal link assembly is adapted to be secured to said first part and said second part is generally disk-shaped and has a peripheral cylindrical surface, said thermal link assembly comprising:

an annular ring made of thermally conductive material, said annular ring being generally in a shape of a revolution with respect to an axis;

said annular ring including an annular base portion to be secured to said first part and a series of contact tongues arranged along said base portion, each said contact tongue having a stem and a head;

each said stem having i) a longitudinal axis extending generally parallel to said axis of said annular ring, ii) a first longitudinal end connected to said base portion, and iii) a second longitudinal end connected to said head;

each said head having a contact surface to be in contact with said peripheral cylindrical surface of said second part;

each said stem being capable of twisting and bending elastic deformation with respect to said longitudinal axis, so that said contact surface of each said head is capable of tilting in any direction and displacing in the radial direction of said annular ring; and an annular band fitted around said annular ring for exerting a force to said head of each contact tongue so as to urge said contact surface of said head against said peripheral cylindrical surface of said second part.

2. A thermal link assembly according to claim 1, wherein:

said annular ring further includes i) an annular proximal portion defining an inner cylindrical surface and ii) a thin-wall cylindrical intermediate portion connecting said base portion and said proximal portion; and said annular ring has a plurality of axial slits formed at fixed circumferential intervals, each axial slit extending from adjacent said base portion, across said thin-wall cylindrical intermediate portion and throughout said annular proximal portion, so that i) a region of said thin-wall intermediate portion between adjacent two of said axial slits defines said stem of each contact tongue, ii) a region of said annular proximal portion between adjacent two of said axial slits defines said head of each contact tongue, and iii) a region of said inner cylindrical surface between adjacent two of said axial slits defines said contact surface of said head of each contact.

3. A thermal link assembly according to claim 2, wherein:

said annular ring is made of metallic material;

said inner cylindrical surface of said annular ring has a diameter in a range 100 to 300 mm;

said stem of each contact tongue has a constant thickness as measured in the radial direction of said annular ring and a constant width as measured in the circumferential direction of said annular ring; and said stem of each contact tongue has a thickness in a range 0.2 to 0.8 mm, a width in a range 2.5 to 15 mm and a length in a range 5 to 50 mm.

4. A thermal link assembly according to claim 3, wherein:

said inner cylindrical surface of said annular ring has a diameter in a range 100 to 200 mm; and said stem of each contact tongue has a thickness in a range 0.2 to 0.5 mm, a width in a range 2.5 to 8 mm and a length in a range 5 to 30 mm.

5. A cryostat for a receiver system used in a radio telescope, comprising:

a vacuum container;

a plurality of cartridges capable of insertion into and removal from said vacuum container, each cartridge having i) at least one thermally conductive cold plate which is generally disk-shaped and has a peripheral cylindrical surface and ii) a receiver mounted on said cold plate;

at least one temperature stage constructed in said vacuum container, said temperature stage having a thermally conductive base plate;

a cryogenic cooler for heat lift of said temperature stage;

a plurality of thermal link assemblies, each secured to said base plate and providing thermal connection between said base plate and one said cold plate; and each said thermal link assembly comprising:

an annular ring made of thermally conductive material, said annular ring being generally in a shape of a revolution with respect to an axis;

said annular ring including an annular base portion to be secured to said base plate and a series of contact tongues arranged along said base portion, each contact tongue having a stem and a head;

each said stem having i) a longitudinal axis extending generally parallel to said axis of said annular ring, ii) a first longitudinal end connected to said base portion, and iii) a second longitudinal end connected to said head;

each said head having a contact surface to be in contact with said peripheral cylindrical surface of said cold plate;

each said stem being capable of twisting and bending elastic deformation with respect to said longitudinal axis, so that said contact surface of said head is capable of tilting in any direction and displacing in the radial direction of said annular ring; and an annular band fitted around said annular ring for exerting a force to said head of each contact tongue so as to urge said contact surface of said head against said peripheral cylindrical surface of said cold plate.

6. A cryostat according to claim 5, wherein:

said annular ring further includes i) an annular proximal portion defining an inner cylindrical surface and ii) a thin-wall cylindrical intermediate portion connecting said base portion and said proximal portion; and said annular ring has a plurality of axial slits formed at fixed circumferential intervals, each axial slit extending from adjacent said base portion, across said thin-wall cylindrical intermediate portion and throughout said annular proximal portion, so that i) a region of said thin-wall intermediate portion between adjacent two of said axial slits defines said stem of each contact tongue, ii) a region of said annular proximal portion between adjacent two of said axial slits defines said head of each contact tongue, and iii) a region of said inner cylindrical surface between adjacent two of said axial slits defines said contact surface of said head of each contact tongue.

7. A cryostat according to claim 6, wherein:

said annular ring is made of metallic material;

said inner cylindrical surface of said annular ring has a diameter in a range 100 to 300 mm;

said stem of each contact tongue has a constant thickness as measured in the radial direction of said annular ring and a constant width as measured in the circumferential direction of said annular ring; and said stem of each contact tongue has a thickness in a range 0.2 to 0.8 mm, a width in a range 2.5 to 15 mm and a length in a range 5 to 50 mm.

8. A cryostat according to claim 7, wherein:

said inner cylindrical surface of said annular ring has a diameter in a range 100 to 200 mm; and said stem of each contact tongue has a thickness in a range 0.2 to 0.5 mm, a width in a range 2.5 to 8 mm and a length in a range 5 to 30 mm.

9. A thermal link assembly for providing thermal connection between a first thermally conductive part and a second thermally conductive part which is generally disk-shaped and has a peripheral cylindrical surface, said thermal link assembly comprising:

an annular ring made of thermally conductive material;

said annular ring including an annular base portion adapted to be secured to said first part and a series of contact tongues arranged along said base portion, each said contact tongue having a stem and a head;

each said stem having i) a longitudinal axis extending generally parallel to an axis of said annular ring, ii) a first longitudinal end connected to said base portion, and iii) a second longitudinal end connected to said head;

each said head having a contact surface adapted to contact said peripheral cylindrical surface of said second part;

each said stem being capable of twisting and bending elastic deformation with respect to said longitudinal axis, so that said contact surface of each said head is capable of tilting in any direction and displacing in the radial direction of said annular ring; and an annular band which fits around said annular ring and exerts a force to said head of each contact tongue so as to urge said contact surface of said head against said peripheral cylindrical surface of said second part.

10. A thermal link assembly according to claim 9, wherein:

said contact tongue heads collectively form an annular proximal portion defining an inner cylindrical surface and said contact tongue stems collectively form a thin-wall cylindrical intermediate portion connecting said base portion and said proximal portion; and said annular ring has a plurality of axial slits formed at fixed circumferential intervals, each axial slit extending from adjacent said base portion, across said thin-wall cylindrical intermediate portion and throughout said annular proximal portion, so that i) a region of said thin-wall intermediate portion between adjacent two of said axial slits defines said stem of each contact tongue, ii) a region of said annular proximal portion between adjacent two of said axial slits defines said head of each contact tongue, and iii) a region of said inner cylindrical surface between adjacent two of said axial slits defines said contact surface of said head of each contact tongue.

11. A thermal link assembly according to claim 10, wherein:

said annular ring is made of metallic material;

said inner cylindrical surface of said annular ring has a diameter in a range 100 to 300 mm;

said stem of each contact tongue has a constant thickness as measured in the radial direction of said annular ring and a constant width as measured in the circumferential direction of said annular ring; and said stem of each contact tongue has a thickness in a range 0.2 to 0.8 mm, a width in a range 2.5 to 15 mm and a length in a range 5 to 50 mm.

12. A thermal link assembly according to claim 11, wherein:

said inner cylindrical surface of said annular ring has a diameter in a range 100 to 200 mm; and said stem of each contact tongue has a thickness in a range 0.2 to 0.5 mm, a width in a range 2.5 to 8 mm and a length in a range 5 to 30 mm.

* * * * *

UNITED STATES PATENT AND TRADEMARK OFFICE

CERTIFICATE OF CORRECTION

PATENT NO. : 6,604,365 B2 
DATED : August 12, 2003
INVENTOR(S) : Yutaro Sekimoto, Katsuhiro Narasaki and Kazufusa Noda It is certified that error appears in the above-identified patent and that said Letters Patent is hereby corrected as shown below:

Column 1,
Line 34, change "The cryostat described by Orlowska et. al. includes a" to
-- The cryostat described by Orlowska et al. includes a --.
Line 42, change "In the cryostat of Orlowska et. al., the radio frequency and" to
-- In the cryostat of Orlowska et al., the radio frequency and --.
Line 63, change "The thermal link assembly described by Orlowska et. al.," to
-- The thermal link assembly described by Orlowska et al., --.

Column 4,
Line 66, change "The third temperature stages is a heat sink stage 30, on" to
-- The third temperature stage is a heat sink stage 30, on --.

Column 6,
Line 25, change "The base plates 38, 40 and temperature stages 30, 32 and" to
-- The base plates 38, 40 and 42 of the temperature stages 30, 32 and --.

Column 7,
Line 34, change "The metallic ring 72 is generally in a shape of revolution" to
-- The metallic ring 72 is generally in a shape of a revolution --.

Column 8,
Line 45, change "The arrow TWA indicates the twisting elastic deformation of" to
-- the arrow TWA indicates the twisting elastic deformation of --.

Column 10,
Line 33, change "contact. " to -- contact tongue. --.

Signed and Sealed this

Third Day of February, 2004

JON W. DUDAS
*Acting Director of the United States Patent and Trademark Office*